US009461426B2

(12) United States Patent
Armacost et al.

(10) Patent No.: US 9,461,426 B2
(45) Date of Patent: Oct. 4, 2016

(54) ELECTRICAL PLUG-SOCKET ASSEMBLY WITH RETAINER SYSTEM AND METHOD

(71) Applicant: Peterson Manufacturing Company, Grandview, MO (US)

(72) Inventors: David S Armacost, Leawood, KS (US); Dale W. Sass, Gardner, KS (US)

(73) Assignee: Peterson Manufacturing Company, Grandview, MO (US)

( * ) Notice: Subject to any disclaimer, the term of this patent is extended or adjusted under 35 U.S.C. 154(b) by 0 days.

(21) Appl. No.: 14/557,191

(22) Filed: Dec. 1, 2014

(65) Prior Publication Data

US 2016/0156131 A1 Jun. 2, 2016

(51) Int. Cl.

| | |
|---|---|
| ***H01R 24/76*** | (2011.01) |
| ***H01R 13/639*** | (2006.01) |
| ***H01R 24/28*** | (2011.01) |

(52) U.S. Cl.

CPC ..... *H01R 24/76* (2013.01); *H01R 13/6395* (2013.01); *H01R 24/28* (2013.01)

(58) Field of Classification Search

CPC ..... H01R 13/6395; H01R 13/6392

See application file for complete search history.

(56) References Cited

U.S. PATENT DOCUMENTS

| | | | | |
|---|---|---|---|---|
| 1,989,823 | A * | 2/1935 | Raabe | H01R 13/447 174/66 |
| 4,457,571 | A * | 7/1984 | Lavine | H01R 13/6395 439/312 |
| 4,741,590 | A * | 5/1988 | Caron | G02B 6/3825 385/60 |
| 5,067,907 | A * | 11/1991 | Shotey | H01R 13/447 174/66 |
| 5,591,043 | A * | 1/1997 | Kenney | H01R 13/6395 439/373 |
| 5,685,732 | A * | 11/1997 | Lane | H01R 13/6392 24/523 |
| 2014/0037260 | A1 * | 2/2014 | Brown | H01R 13/6392 385/136 |

* cited by examiner

*Primary Examiner* — Gary Paumen

(74) *Attorney, Agent, or Firm* — Polsinelli PC; Adam C. Rehm; Richard P. Stitt

(57) ABSTRACT

An electrical plug-socket assembly with a retainer operable to securely engage a plug and a socket and prevent displacement of the plug relative to the socket.

19 Claims, 3 Drawing Sheets

ELECTRICAL PLUG-SOCKET ASSEMBLY WITH RETAINER SYSTEM AND METHOD

BACKGROUND

1. Field of the Invention

The present inventive concept generally relates to electrical connectors. More specifically, embodiments of the present inventive concept concern an electrical plug-socket system having an assembly that includes a retainer operable to ensure that a secure connection between a plug and a socket is maintained.

2. Description of the Related Art

Electrical devices are commonly powered via wired transmission of electricity. Such electrical devices typically utilize a power cord with a plug that is removably secured to an electrical socket that is connected to a power source. Upon connection of the plug to the socket, electricity is transmitted from the power source to the electrical device, which allows operation of the electrical device.

Many plugs and sockets are designed to facilitate easy connection and disconnection from each other via application of a small force. Thus, it is common for such plugs and sockets to be inadvertently disconnected, which is undesirable because such interferes with efficient operation of the electrical device.

An attempt to address this problem is presented by U.S. Pat. No. 6,491,539 to Johnston, which is incorporated herein by reference in its entirety. Johnston provides a retrofit device that is screwed into an aperture of a socket in place of a pre-existing screw that must be removed. Once the device is secured, a zip tie is threaded through the device and cinched tight around a cord of a plug secured to the socket. The Johnston device is complex to use and, therefore, undesirable. Further, the Johnston device is not able to shield the socket and the plug, so debris is allowed to enter, which could interfere with transmission of electricity and pose a fire hazard.

In view of the aforementioned problems, there is a need for an electrical plug-socket assembly that ensures a secure connection between a plug and a socket, provides shielding for the plug and socket, is easily and economically manufactured, is easily installed, and does not materially interfere with the underlying purpose of transmitting electricity and facilitates reliable operation thereof.

SUMMARY

The following summary is provided to indicate the nature of the subject matter disclosed herein. While certain aspects of the present inventive concept are described below, the summary is not intended to limit the scope of the present inventive concept.

Embodiments of the present inventive concept provide an electrical plug-socket assembly with a retainer to ensure a secure connection between an electrical plug having a power cord and a wall-mounted electrical socket, prevent inadvertent disconnection between the plug and the socket, and provide a barrier shield for the plug and the socket. Additionally, the present inventive concept is easily and economically manufactured and easily installed.

The present inventive concept provides, in its simplest form, an electrical plug having at least one male or female terminal that is sized and shaped to mate with a corresponding female or male terminal of an electrical socket, and a retainer sized and shaped to mate with the plug and the socket so as to ensure a secure connection between the plug and the socket and to prevent inadvertent disconnection of the plug and the socket. In this manner, the plug can only be disconnected from the socket via removing the retainer from the plug and the socket.

The aforementioned aspects may be achieved in one aspect of the present inventive concept by providing a plug-socket connection system having a plug, a socket, and/or a retainer. The plug may include at least one male or female electrical-connection plug contact at a first end of the plug, and/or at least a portion of a power cord depending from a second end of the plug and in electrical communication with the at least one plug contact. The socket may have at least one male or female electrical-connection socket contact, and/or a receiver at least partially surrounding the at least one socket contact. The retainer may have a plug engagement mechanism operable to securely engage the plug, and/or a socket engagement mechanism operable to securely engage the socket via the receiver so that, upon engagement of the retainer with the socket and the plug, the retainer securely engages the plug to the socket and prevents horizontal displacement of the plug relative to the socket.

The socket may include a plate that defines a first abutment surface, and a mating structure that projects from the plate and includes flared portions on either side that each define a second abutment surface. The first abutment surface may face the second abutment surface. Each of the second abutment surfaces may define a void between the first abutment surface and a respective one of the abutment surfaces. Each of the voids may be sized and shaped to receive at least a portion of the socket engagement mechanism of the retainer therein. The at least one socket contact may extend at least partially through the mating structure. The voids may be spaced from each other by the at least one socket contact. The mating structure may include a third abutment surface that extends between the first abutment surface and the second abutment surfaces, spaces the first abutment surface from the second abutment surfaces, and/or is annular and defines an axis of rotation. Each of the flared portions may include a fourth abutment surface operable to prevent rotation of the retainer relative to the socket about the axis of rotation upon engagement with the retainer. The retainer may include a receiver that is operable to abut and partially extend along the third abutment surface. The retainer may include a projection on each side of the receiver. Each of the projections may extend perpendicular to the first and second abutment surfaces and may be operable to abut the fourth abutment surfaces. The retainer may include depending arms on each side of the receiver. Each of the depending arms may be operable to extend into the void to abut the first and second engagement surfaces. Each of the depending arms may include a friction-addition feature operable to increase friction between the depending arms and the first and second surfaces. The retainer may include a resilient backstop operable to abut the plug.

The aforementioned aspects may be achieved in another aspect of the present inventive concept by providing an electrical connector. The electrical connector may include a plug-socket retainer mechanism having (i) a back wall with socket engagement arms to slidably engage a socket and provide a friction-fit engagement between the retainer mechanism and the socket, and a socket abutment surface to partially surround a portion of the socket thereby providing a socket receiver section, (ii) a top wall extending from the back wall to provide a grip thereby providing a handle section, and/or (iii) a resilient backstop arm depending from the top wall to abut a plug thereby providing a plug engagement section. The retainer mechanism may be operable to ensure a secure engagement between the plug and the socket upon engagement of the retainer mechanism with the socket and the plug. The backstop arm may be angled toward the back wall to bias the plug toward the socket. The electrical connector may include a projection on each side of the retainer mechanism. Each of the projections may extend perpendicular to a surface of the back wall. Each of the engagement arms may include a friction-addition feature operable to increase friction between the retainer mechanism and the socket. Each of the friction-addition features may include a ridge extending toward the backstop arm.

The aforementioned aspects may be achieved in another aspect of the present inventive concept by providing method of manufacturing an electrical connection retainer system. The method may include the step of forming a retainer with abutment surfaces operable to simultaneously engage a surface of a socket having an electrical contact operable to receive a plug, and a surface of the plug. One of the abutment surfaces of the retainer may be a socket engagement arm extending from a back wall of the retainer. The socket engagement arm may be operable to slidably engage the socket and provide a friction-fit engagement between the retainer and the socket. Another one of the abutment surfaces may be a backstop depending from a top wall of the retainer. The backstop may be operable to abut the plug and bias the plug toward the socket. The method may include the step of forming a socket abutment surface to partially surround a portion of the socket. The method may include the step of forming anti-rotation stops on each side of the socket abutment surface to prevent rotation of the retainer relative to the socket. The method may include the step of forming a ledge between each of the anti-rotation stops and the socket abutment surface. The method may include the step of forming a groove between one of the anti-rotation stops and the socket engagement arm.

Other aspects and advantages of the present inventive concept will be apparent from the following detailed description of the preferred embodiments and the accompanying drawings figures.

BRIEF DESCRIPTION OF THE FIGURES

Embodiments of the present inventive concept are described herein with reference to the following drawing figures, wherein.

DETAILED DESCRIPTION

The present inventive concept is susceptible of embodiment in many forms. While the drawings illustrate, and the specification describes, certain embodiments of the invention, it is to be understood that such disclosure is by way of example only. The principles of the present inventive concept are not limited to the particular disclosed embodiments.

Figure 1:
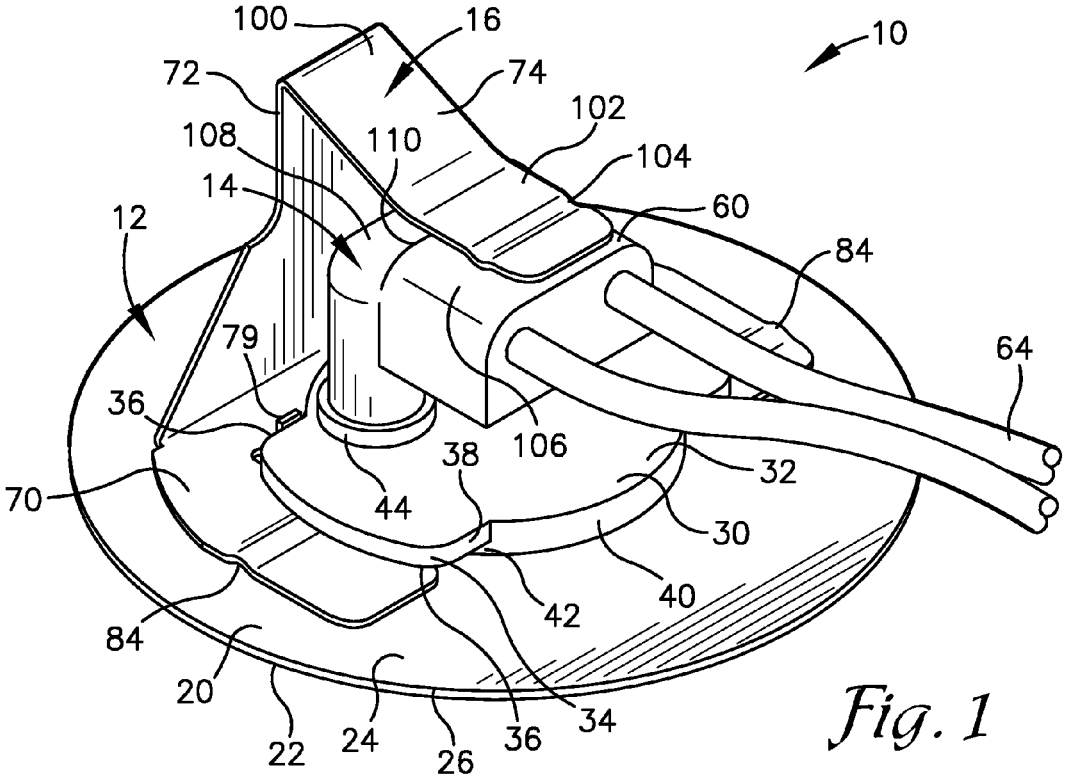
FIG. 1 is a perspective view of an electrical plug and retainer system in accordance with an exemplary embodiment of the present inventive concept, illustrating the system completely assembled.
Figure 3:
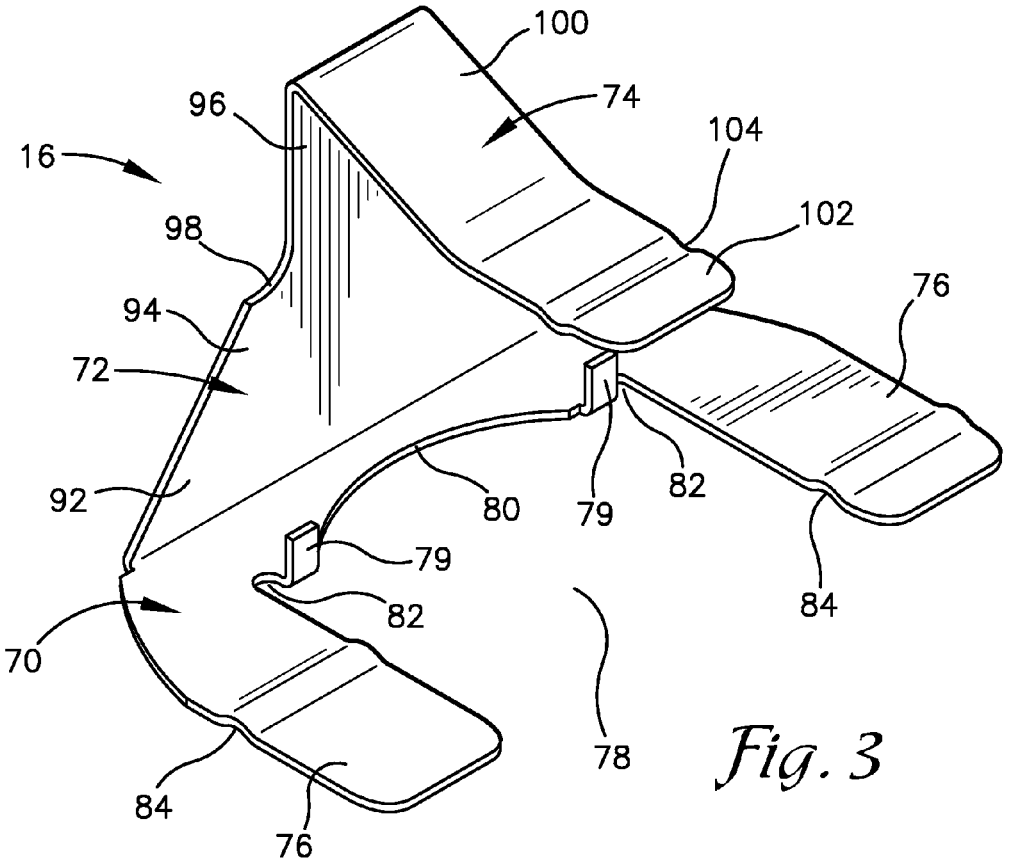
FIG. 3 is a perspective view of a retainer of the electrical plug and retainer system illustrated in FIG. 1.
Figure 2:
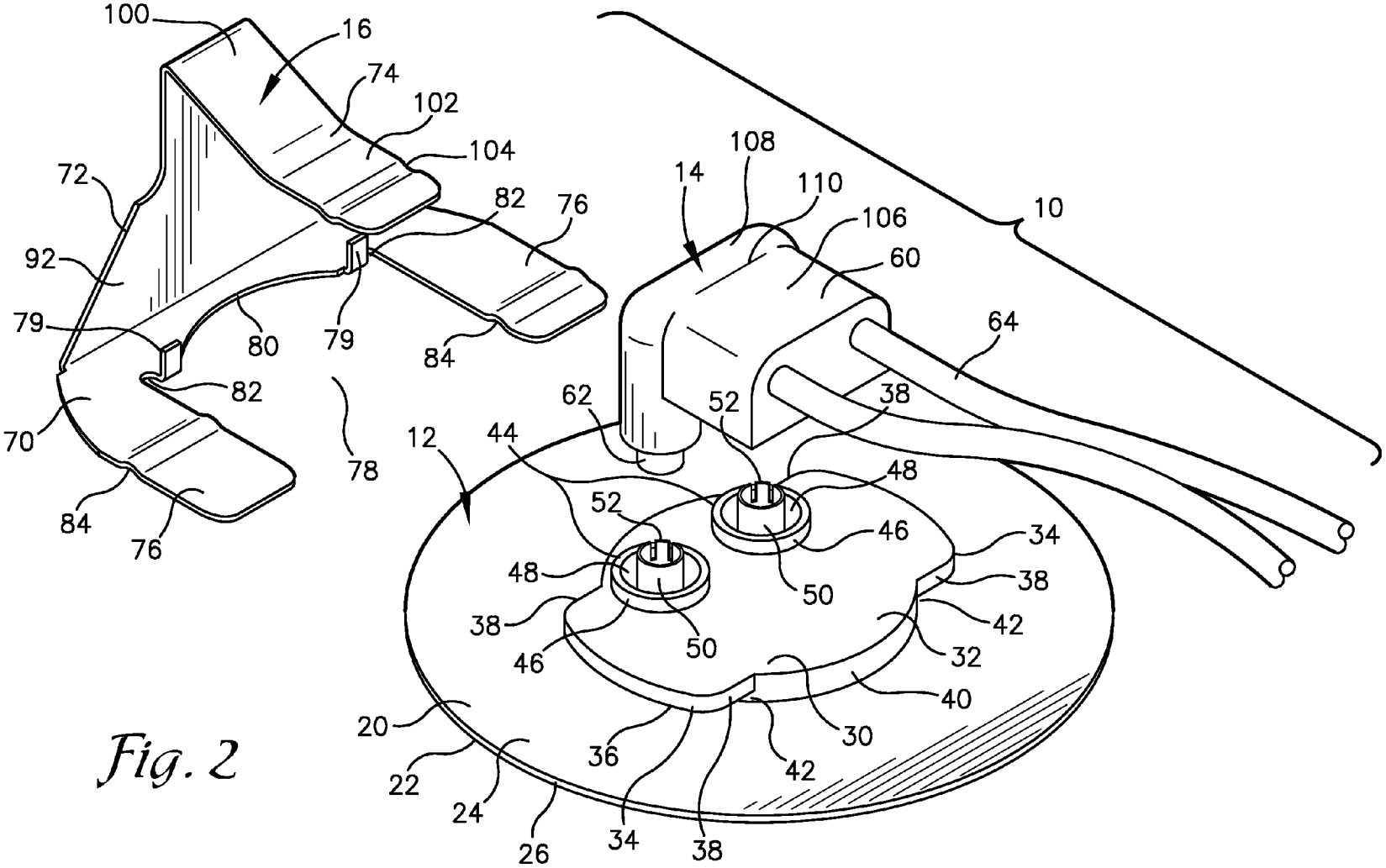
FIG. 2 is a perspective view of the electrical plug and retainer system illustrated in FIG. 1, illustrating the system completely disassembled.
Figure 4:
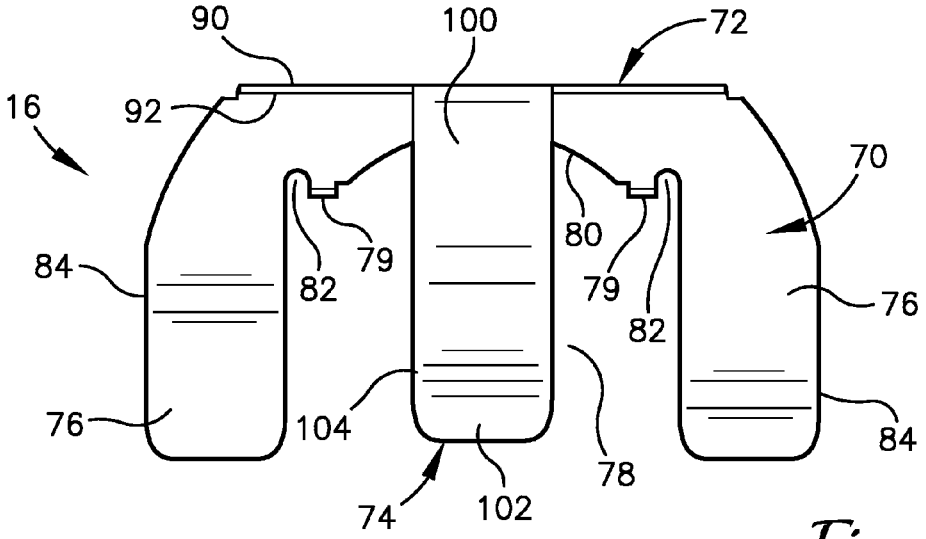
FIG. 4 is a top plan view of the retainer illustrated in FIG. 3.
Figure 5:
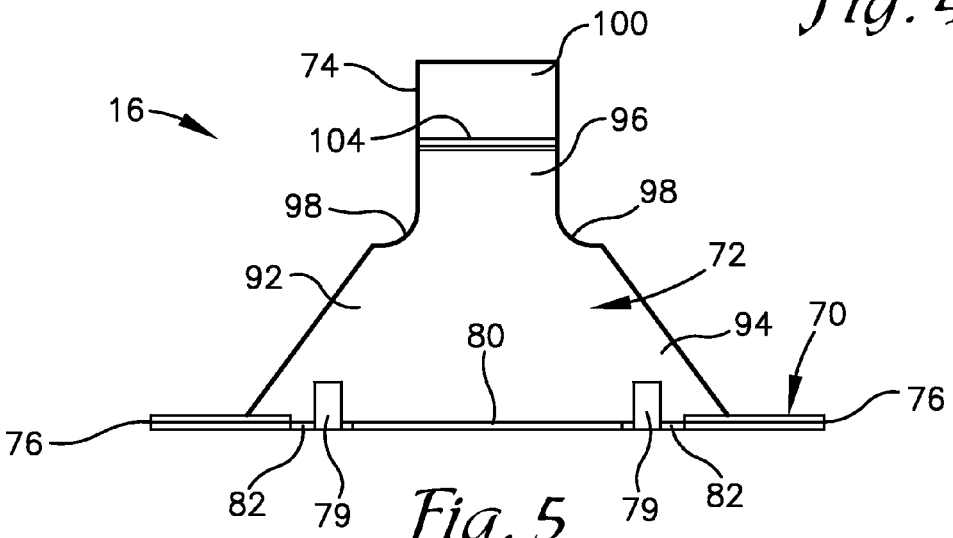
FIG. 5 is a front elevation view of the retainer illustrated in FIG. 3.
Figure 6:
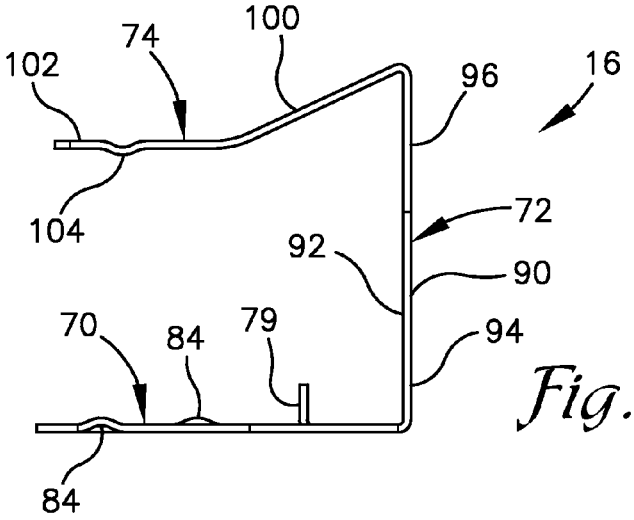
FIG. 6 is a left side elevation view of the retainer illustrated in FIG. 3.

With initial reference to FIGS. 1 and 2, an electrical plug-socket system 10 is illustrated. The system 10 generally includes a socket 12, a plug 14, and a retainer 16 configured to simultaneously engage the socket 12 and the plug 14 to ensure a secure connection therebetween.

The socket 12 includes a plate 20 having a rear-facing abutment surface 22 to abut at least partially against a mounting surface. In the exemplary embodiment, the socket 12 is a wall-mounted electrical socket, but it is foreseen that the socket 12 can be mounted on a flat surface, e.g., a floor, a ceiling, a panel or the like, without deviating from the scope of the present inventive concept. On an opposite side of the rear-facing abutment surface 22 is a front-facing abutment surface 24. The surfaces 22, 24 are spaced from each other via an edge 26 that defines an outermost perimeter of the surfaces 22, 24. In the exemplary embodiment, the outermost perimeter of the surfaces 22, 24 is circular, but it is foreseen that the outermost perimeter can be any shape, e.g., oval, rectangular, square or the like, without deviating from the scope of the present inventive concept.

The socket 12 includes a mating structure 30 that projects from the front-facing abutment surface 24 of the plate 20. The mating structure 30 includes a face 32 with flared portions 34 on either side of the face 32. Each of the flared portions 34 defines rear-facing abutment surfaces 36 and lateral abutment-surfaces 38 on either side of the rear-facing abutment surfaces 36. The rear-facing abutment surfaces 36 of the flared portions 34 are spaced from the front-facing abutment surface 24 of the plate 20 via sidewall 40 of the mating structure 30. In this manner, voids 42 are defined between each of the rear-facing abutment surfaces 36 of the flared portions 34 and the front-facing abutment surface 24 of the plate 20. The sidewall 40 also spaces the front-facing abutment surface 24 of the plate 20 from the face 32 of the mating structure.

The socket 12 includes a pair of electrical contact receivers 44 that are identically sized and shaped to partially receive a portion of the plug 14 and form an electrical connection between the socket 12 and the plug 14. Each of the receivers 44 includes a circular perimeter wall 46 that surrounds a cavity 48 having an outwardly-projecting electrical contact 50 with a biasing feature 52. The cavity 48 extends through the mating structure 30 and at least partially through the plate 20. It is foreseen that the socket 12 can have any number of receivers 44, e.g., one receiver, without deviating from the scope of the present inventive concept.

The plug 14 includes a housing 60. A pair of electrical contacts 62 is partially housed within the housing 60 and partially extends from the housing 60. The pair of electrical contacts 62 of the plug 14 are sized and shaped to securely connect with the pair of electrical contacts 50 of the socket 12 to form an electrical connection therebetween. The biasing feature 52 is biased toward the electrical contact 62 so as to increase friction between the electrical contacts 50, 62. In this manner, the connection between the socket 12 and the plug 14 is further secured. Depending from the housing 60 of the plug 14 is a power cord 64 that is in electrical communication with the contacts 50, 62 and operable to deliver electricity from the socket 12 and the plug 14 to an electrical device connected thereto.

The retainer 16 includes a back wall or socket receiver section 70, a top wall or handle section 72, and a backstop arm or plug engagement section 74. The socket receiver section 70 includes arms 76 that extend from each side of the socket receiver section 70 to define a void 78 between the arms 76. A pair of projections 79 extends from within the void 78 and perpendicular to the abutment surfaces 22, 24 and the face 32 of the socket 12. The projections 79 advantageously prevent rotation of the retainer 16 relative to the socket 12 upon assembly of the system 10.

Between the projections 79 is a concave socket abutment surface 80 that is configured to partially surround the socket 12 via abutment along a portion of the sidewall 40 of the socket 12 that extends between and past the projections 79 toward the handle section 72 upon assembly of the system 10. Between each of the arms 76 and each of the projections 79 is a groove 82 that advantageously imparts a degree of resiliency to the arms 76 with respect to the socket receiver section 70 thereby facilitating assembly of the system 10. Along each of the arms 76 is a friction-addition feature 84 operable to increase friction between the arms 76 of the retainer 16, the front abutment surface 24 of the plate 20 of the socket 12, and the rear-facing abutment surface 36 of the mating structure 30 of the socket 12 upon assembly of the system 10. In the exemplary embodiment, the friction-addition features 84 are spaced differently along the arms 76 relative to each other, but it is foreseen that the friction-addition features 84 may be equally spaced along the arms relative to each other without deviating from the scope of the present inventive concept. Likewise, it is foreseen that any number of friction-addition features 84 may be formed along each of the arms 76 to further increase friction between at least the aforementioned components without deviating from the scope of the present inventive concept.

The handle section 72 of the retainer 16 extends from the socket receiver section 70 at a ninety degree angle from a plane defined by the abutment surfaces 22, 24. The handle section 72 includes opposing outer and inner gripping surfaces 90, 92 for handling the retainer 16, e.g., during assembly of the system 10. The handle section 72 partially surrounds the socket 12 and the plug 14 so that, upon assembly of the system 10, the handle section 72 provides a barrier shield and helps to prevent foreign objects, e.g., debris, from coming into contact with the socket 12 and the plug 14. It should be noted that all components of the retainer 16 collaboratively provide shielding to the socket 12 and the plug 14. An inner portion 94 of the handle section 72 has converging edges and becomes progressively narrow extending away from the socket receiver section 70, and an outer portion 96 of the handle section 72 has parallel sidewalls. The portions 94, 96 are separated by grooves 98 that advantageously impart a degree of resilience to the outer portion 96 of the handle section 72 relative to the inner portion 94, the socket receiver section 70, and a plug engagement section 74 of the retainer 16.

The plug engagement section 74 of the retainer 16 includes an inner portion 100 that extends from the handle section 72 at an angle that is preferably between thirty to sixty degrees from a plane defined by the gripping surfaces 90, 92, e.g., thirty, forty-five, or sixty degrees, and most preferably an angle that is thirty degrees from the plane defined by the gripping surfaces 90, 92. The plug engagement section 74 also includes an outer portion 102 that extends parallel to the plane defined by the abutment surfaces 22, 24 of the socket receiver section 70. The outer portion 102 includes a friction-addition feature 104 similar to the features 84, but extending in an opposite direction of the features 84, i.e., the feature 104 extends toward the features 84 to cooperatively decrease space between the socket receiver section 70 and the plug engagement section 74. The feature 104 is operable to increase friction between the plug engagement section 74 of the retainer 16 and the plug 14 upon assembly of the system 10. In the exemplary embodiment, the friction-addition feature 104 is a single feature that is spaced from the inner portion 100 by and along the outer portion 102. It is foreseen, however, that any number of the friction-addition features 104 may be formed along the outer portion 102 and between the portions 100, 102 to further increase friction between at least the aforementioned components without deviating from the scope of the present inventive concept.

To assemble the system 10, the socket 12 is connected to a source of electricity and installed partially into a surface, e.g., a vertical wall in the exemplary embodiment, so that the rear abutment surface 22 is abutting the wall, the plate 20 and mating structure 30 are exposed, and the contacts 52 are substantially horizontally aligned with respect to the vertical wall. In this manner, the contacts 50 are in electrical communication with the source of electricity. The plug 14 is connected to the socket 12 by sliding the contacts 62 of the plug 14 into and around the contacts 50 of the socket 12 until outermost edges of the contacts 62 simultaneously abut lowermost surfaces of the cavities 48. In the exemplary embodiment, the contacts 50 have a female configuration and the contacts 62 have a male configuration. It is foreseen, however, that these configurations can be reversed, e.g., the contacts 62 having a female configuration and the contacts 50 having a male configuration, and/or a combination of each without deviating from the scope of the present inventive concept. In this manner, the contacts 62 are in electrical communication with the contacts 50 and the source of electricity.

The retainer 16 is positioned above the socket 12 and the plug 14 so that the arms 76 extend parallel to the front abutment surface 24 and are aligned between the front abutment surface 24 and the rear abutment surfaces 36. Once aligned, the retainer 16 is moved toward the socket 12 and the plug 14 so that the arms 76 slide along and between the front abutment surface 24 and the rear-facing abutment surfaces 36 until each of the projections 79 and the concave socket abutment surface 80 simultaneously abut the lateral abutment surfaces 38 and the sidewall 40, respectively.

A length of the handle section 72 is calculated by measuring a distance between the front abutment surface 24 of the plate 20 of the socket 12 and a retainer engagement portion 106 of the housing 60 of the plug 14, subtracting a distance between a point of connection between the sections 72, 74 and the feature 104, and further subtracting a predetermined amount, e.g., one to five centimeters. During and simultaneous with the movement of the retainer 16 toward the socket 12 and the plug 14, the outer portion 100 of the plug engagement section 74 abuts and slide along a head 108 of the housing 60 of the plug 14, which causes the retainer 16 to deform and expand with a portion of the plug engagement section 74 moved in a direction away from the socket receiver section 70. The plug engagement section 74 continues to slide along the head 108 of the housing 60, past a groove 110 that separates the head 108 from the retainer engagement portion 106, and only partially along the retainer engagement portion 106 until each of the projections 79 and the concave socket abutment surface 80 simultaneously abut the lateral abutment surfaces 38 and the sidewall 40, respectively. When the outer portion 102 reaches the plug engagement section 74, the retainer 16 at least partially assumes its original shape, i.e., its shape prior to the aforementioned deformation, due to the resilient nature of the plug engagement section 74. At this point, assembly of the system 10 is complete.

In the exemplary embodiment, the length of the handle section 72 is set such that the retainer 16 remains slightly deformed after assembly of the system 10 so that the plug engagement section 74 continues to apply a force to the plug 14 in a direction toward the plug 14 and the socket 12. In this manner, the plug 14 is biased toward the socket 12 so that the electrical connection between the plug 14 and the socket 12 is maintained. It is foreseen, however, that the retainer 16 may not be deformed after assembly of the system 10 by determining the length of the handle section 72 without subtracting the predetermined amount, e.g., one to five centimeters, without deviating from the scope of the present inventive concept.

The system 10 may be manufactured using plastic and/or metal or the like, and is preferably manufactured using a combination of plastic and metal. In the exemplary embodiment, the socket 12 and the plug 14 are injection molded using a durable polymer that has high impact strength, good dimensional stability, and excellent insulating and other electrical properties such as polycarbonate. The contacts 52, 62 and associated wiring are made of a metal with low electrical resistance such as copper. The retainer is formed via punching and/or stamping a metal having a degree of resilience such as aluminum.

The preferred forms of the present inventive concept described above are to be used as illustration only, and should not be used in a limiting sense to interpret the scope of the present inventive concept. Modifications to the exemplary embodiments, set forth above, could be readily made by those skilled in the art without departing from the spirit of the present inventive concept.

The inventors hereby state their intent to rely on the Doctrine of Equivalents to determine and assess the reasonably fair scope of the present inventive concept as it pertains to any apparatus not materially departing from but outside the literal scope of the invention as set forth in the following claims.

What is claimed is:

1. A plug-socket connection system comprising:

a plug having at least one male or female electrical-connection plug contact;

a socket having (i) at least one male or female electrical-connection socket contact, and (ii) a receiver at least partially surrounding the at least one socket contact; and a retainer having (i) a plug engagement mechanism operable to securely engage the plug, and (ii) a socket engagement mechanism operable to securely engage the socket via the receiver so that, upon engagement of the retainer with the socket and the plug, the retainer securely engages the plug to the socket and prevents displacement of the plug relative to the socket, wherein, the socket includes (i) a plate that defines a first abutment surface, and (ii) a mating structure that projects from the plate and includes portions on either side that each define a second abutment surface, the first abutment surface faces the second abutment surfaces, and the mating structure includes a third abutment surface that (i) extends between the first abutment surface and the second abutment surfaces, and (ii) spaces the first abutment surface from the second abutment surfaces.

2. The plug-socket connection system of claim 1, wherein, the portions on either side of the mating structure are flared portions.

3. The plug-socket connection system of claim 1, wherein, each of the second abutment surfaces define a void between the first abutment surface and a respective one of the second abutment surfaces, and each of the voids are sized and shaped to receive at least a portion of the socket engagement mechanism of the retainer therein.

4. The plug-socket connection system of claim 3, wherein, the at least one socket contact extends at least partially through the mating structure, and the voids are spaced from each other by the at least one socket contact.

5. The plug-socket connection system of claim 1, wherein the third abutment surface is annular and defines an axis of rotation.

6. The plug-socket connection system of claim 5, wherein each of the portions on either side of the mating structure include a fourth abutment surface operable to prevent rotation of the retainer relative to the socket about the axis of rotation upon engagement with the retainer.

7. The plug-socket connection system of claim 1, wherein the retainer includes a receiver that is operable to abut and partially extend along the third abutment surface.

8. The plug-socket connection system of claim 7, wherein, the retainer includes a projection on each side of the receiver, and each of the projections extend perpendicular to the first and second abutment surfaces and are operable to abut the fourth abutment surfaces.

9. The plug-socket connection system of claim 8, wherein, the retainer includes depending arms on each side of the receiver, and each of the depending arms is operable to extend into the void to abut the first and second engagement surfaces.

10. The plug-socket connection system of claim 9, wherein each of the depending arms include a friction-addition feature operable to increase friction between the depending arms and the first and second surfaces.

11. The plug-socket connection system of claim 6, wherein the retainer includes a resilient backstop operable to abut the plug.

12. An electrical connector comprising:

a plug-socket retainer mechanism having (i) a back wall with socket engagement arms to slidably engage a socket within voids on either side of the socket to provide a friction-fit engagement between the retainer mechanism and the socket, and a socket abutment surface to partially surround a portion of the socket, (ii) a top wall extending from the back wall, and (iii) a resilient backstop depending from the top wall to abut a plug and not allow a plug cord or portion of the plug to pass therethrough, wherein, the retainer mechanism is operable to ensure a secure engagement between the plug and the socket upon engagement of the retainer mechanism with the socket and the plug.

13. The electrical connector of claim 12, wherein the backstop includes only one arm angled toward the back wall to provide only a single point of contact between the retainer mechanism and the plug and to bias the plug toward the socket.

14. The electrical connector of claim 12, further comprising:

a projection on each side of the retainer mechanism, each of the projections extending perpendicular to a surface of the back wall.

15. The electrical connector of claim 12, wherein each of the engagement arms include a friction-addition feature operable to increase friction between the retainer mechanism and the socket.

16. The electrical connector of claim 12, wherein each of the friction-addition features includes a ridge extending toward the backstop.

17. A method of manufacturing an electrical connection retainer system, the method comprising the step of:

forming a retainer with abutment surfaces operable to simultaneously engage (i) a surface of a socket having an electrical contact operable to receive a plug, and (ii) a surface of the plug, wherein, one of the abutment surfaces of the retainer is a socket engagement arm extending from a back wall of the retainer, the socket engagement arm is operable to slidably engage the socket within voids on either side of the socket to provide a friction-fit engagement between the retainer and the socket, and another one of the abutment surfaces is a backstop depending from a top wall of the retainer, the backstop is operable to abut the plug and bias the plug toward the socket, the backstop not allowing a plug cord or portion of the plug to pass therethrough.

18. The method of manufacturing the system of claim 17, further comprising the steps of:

forming a socket abutment surface to partially surround a portion of the socket; and forming anti-rotation stops on each side of the socket abutment surface to prevent rotation of the retainer relative to the socket.

19. The method of manufacturing the system of claim 18, further comprising the step of:

forming a groove between one of the anti-rotation stops and the socket engagement arm.

* * * * *